United States Patent [19]

Mower et al.

[11] Patent Number: 4,767,297

[45] Date of Patent: Aug. 30, 1988

[54] CORNER FINISHING TOOL

[75] Inventors: Morris F. Mower, Santa Clara; Haim Cezana, S. San Francisco, both of Calif.

[73] Assignee: Axia Incorporated, Oak Brook, Ill.

[21] Appl. No.: 31,763

[22] Filed: Mar. 30, 1987

[51] Int. Cl.[4] ..... B05C 17/10

[52] U.S. Cl. ..... 425/87; 15/235.7; 15/235.8; 425/458

[58] Field of Search ..... 425/87, 458

[56] References Cited

U.S. PATENT DOCUMENTS

| | | | |
|---|---|---|---|
| 2,420,062 | 5/1947 | Ames | 425/87 |
| 2,594,606 | 4/1952 | Ames | 425/87 |
| 2,824,443 | 2/1958 | Ames | 425/87 |
| 3,932,101 | 1/1976 | Johnson et al. | 425/458 |
| 4,032,283 | 6/1977 | Johnson et al. | 425/458 |
| 4,116,604 | 9/1978 | Johnson et al. | 425/458 |
| 4,451,223 | 5/1984 | Mower et al. | 425/458 |
| 4,619,013 | 10/1986 | Yon | 425/458 |

FOREIGN PATENT DOCUMENTS

| | | | |
|---|---|---|---|
| 800837 | 9/1958 | United Kingdom | 15/235.7 |

*Primary Examiner*—Willard Hoag

*Attorney, Agent, or Firm*—Kirkland & Ellis

[57] ABSTRACT

A corner finishing tool having means to contain a supply of mastic and having generally perpendicular means defining a corner with wear pads.

7 Claims, 1 Drawing Sheet

FIG. 1
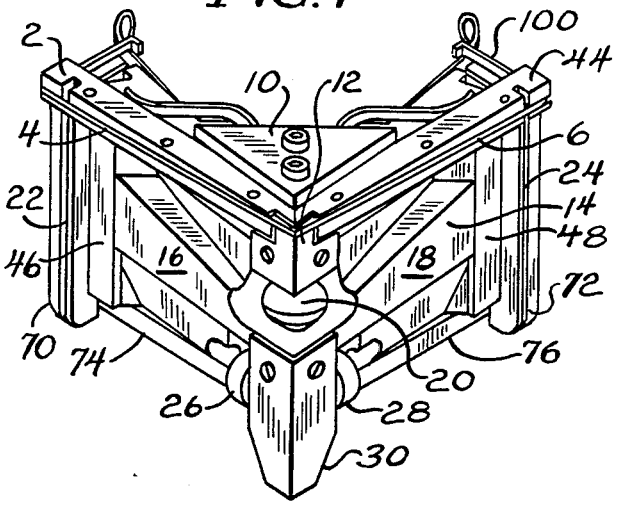
FIG. 3
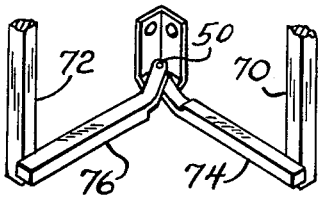
FIG. 2
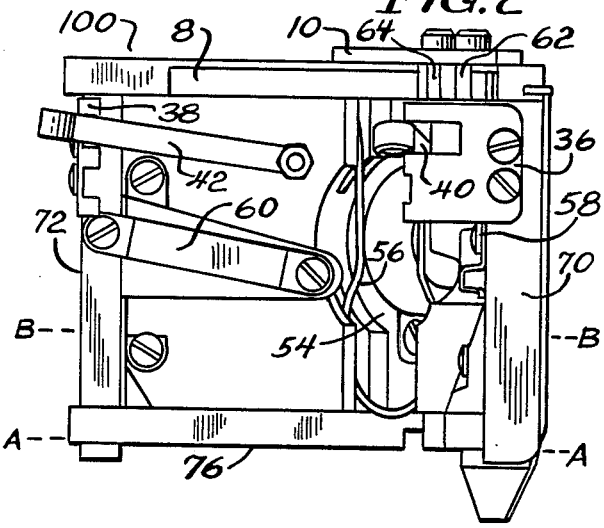
FIG. 4
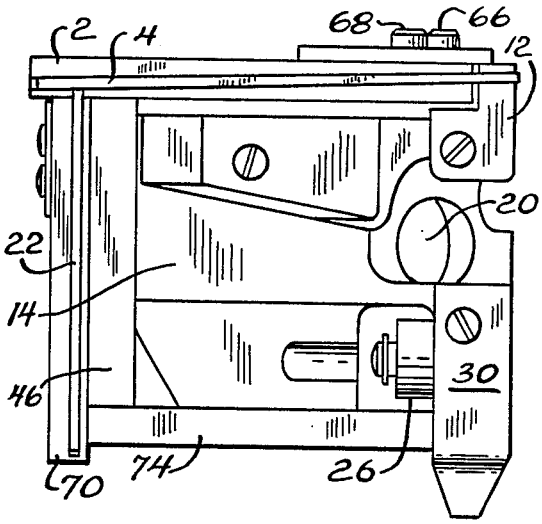
FIG. 5
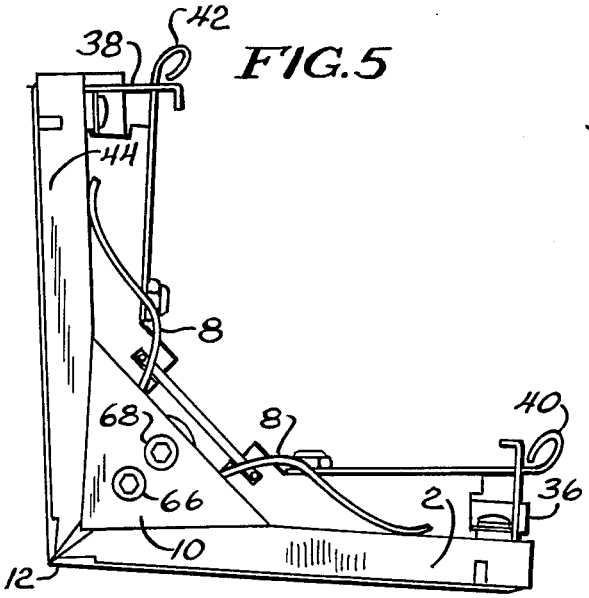
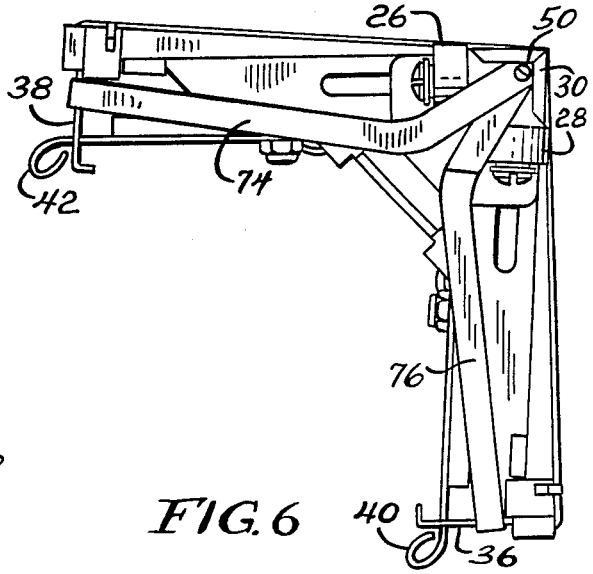
FIG. 6

CORNER FINISHING TOOL

BACKGROUND OF THE INVENTION

1. Field of Invention

This invention relates generally to mastic dispensing tools and more particularly to corner finishing tools for applying mastic along a corner wall joint. Although tools of this general kind are presently known. the invention described herein is believed to be a improvement thereon.

2. Description of the Prior Art

Corner finishing tools such as those described in U.S. Pat. Nos. 2,8241,447 and 3,932,101 are devices designed to manually apply a layer of mastic to the corner joint formed where two wall board sections meet in a way such that the top layer of mastic covers the tape and forms the actual corner joint. so that the mastic appears to merge into the wallboard surface. However. the primary parts of the prior art finishing tools. the head casting and the frame, have a tendency to wear out due to the pressure and friction that are applied to the tool when it is used.

SUMMARY OF THE INVENTION

The principal object of the present invention is to provide a corner finishing tool in which wear of the frame due to pressure applied to the tool during use is minimized.

Another object of the invention is to provide a corner finishing tool in which wear of the head casting and the frame is eliminated. and in which it is possible to adjust the spacing between the head casting and the frame.

Another object of the invention is to provide a corner finishing tool having reduced friction between the wall and the tool.

Another object of the invention is to provide a corner finishing tool in which the user can control the thickness of the mastic or "mud" coat applied.

Another object of the invention is to provide a corner finishing tool in which the frame is firmly secured to the head so that the frame cannot open and slide off of the head.

This invention provides a tool with a hinge action which minimizes wear of the frame by transferring pressure from top and bottom wear pads mounted on the head of the tool to pivots and springs attached to the frame of the tool. Wear is also reduced by the addition of two adjustable side wear pads that provide an insert between the head and frame.

This invention reduces friction between the wall and the tool by including wheels on each side of the head. providing smooth. easy operation of the tool as it is moved along the wall.

Finally. this invention allows the user to control the thickness of the mastic coat applied by engaging or disengaging adjustable springs attached to the frame. Another set of springs is attached to each side of the frame to the head, thereby preventing the frame from opening and sliding off the head.

Other objects and advantages of this invention will become apparent in view of the following detailed description.

BRIEF DESCRIPTION OF THE DRAWINGS

FIG. 1 is a perspective view of a preferred embodiment of the invention in a corner finishing tool:

FIG. 2 is a rear side view of the tool;

FIG. 3 is a perspective view of the blade holder assembly. taken between lines A—A and B—B of FIG. 2.

FIG. 4 is a front side view of the tool;

FIG. 5 is a top plan view of the tool;

FIG. 6 is a bottom plan view of the tool.

DETAILED DESCRIPTION

Referring to FIG. 1 in particular. finishing tool 100 comprises a container means for mastic material defining a cavity that is open in two convergent and substantially perpendicular planes and having surfaces that converge peripherally at the cavity for doctoring mastic material that flows thereunder.

Referring to FIGS. 1. 2. 4. and 6 in particular, the body of the tool IOO comprises a pair of carbide or steel blades 4 and 6. left and right. the thickness of which are sufficient to render the blades substantially rigid. The blades 4 and 6 are enclosed in cast aluminum or steel top frames 2 and 44. which are connected by frame-keeper 10 and held together by two frame-keeper screws 66 and 68. The blades 4 and 6 are tightly joined together perpendicularly to two skids 22 and 24. left and right, which are perpendicularly connected to the left and right ends of the blades 4 and 6 and enclosed in frame-uprights 70 and 72, respectively. The frame-uprights 70 and 72 are then perpendicularly connected to bottom frames 74 and 76, respectively.

The body of tool 100 also includes a head casting 14, preferably cast of aluminum or other suitable material, which also has two sides or retainer walls, 16 and 18, left and right. Frame-keeper 10 is attached to head casting 14 by frame-keeper screws 66 and 68. front and back, around which spacer bushings 62 and 64 have been placed between frame-keeper 10 and head casting 14 to allow proper spacing for movement of the frames 2 and 44.

While prior art head castings were subject to wear due to friction along the sides between the head and frame. the tool described herein also includes adjustable side wear pads 46 and 48, left and right, preferably made of steel or other suitable material, inserted between the head casting 14 and frames 2 and 44 on both the left and right sides 16 and 18 of the head casting 14. The addition of these side wear pads 46 and 48 eliminates head wear due to friction between head casting and frame.

Top and bottom wear pads 12 and 30 are secured to the head casting 14 by screws or other suitable means. In corner finishing tools described in the prior art, the frames and bottom frames were held together by means of center clips inserted through peripheral slots or grooves in the head casting and frames at right angles to the frames. Pressure applied to the tool during use wore out the slots. thus requiring replacement of the frames and blades. In the tool described herein. the frames and bottom frames are in contact with top and bottom wear pads 12 and 30 and the pressure applied against bottom wear pad 30 is transferred to screw frame pivot 50. as shown in FIG. 3. Similarly. the pressure applied against top wear pad 12 is transferred to the spring/frame stops 58 and 60, as shown in FIG. 2. Thus. the only parts that are likely to wear out due to pressure applied against the center of the tool are the top and bottom wear pads, which are easily replaceable.

The body of the tool 100 also includes two wheels 26 and 28 mounted on two wheel bushings on the left and right sides of tool 100 as shown in FIGS. 1, 4 and 6. These wheels are designed to reduce friction between the wall and tool 100 for smooth and easy operation when tool 100 is in use.

Tool 100 also includes an improved spring tension adjusting system by which the user is able to control the thickness of the mastic coat applied. Adjustable biasing springs 40 and 42 consisting of an elongated member of spring steel or some other suitable elongated member of spring steel or some other suitable material, attached on one end to the inside of the retainer plates and aligned so that the unattached end may positioned so as to apply an outward force against the frames when the biasing springs are held in place by adjustable biasing spring holders 36 and 38, as shown in FIGS. 2 and 5. By engaging or disengaging adjustable biasing springs 36 and 38 by removing them from adjustable biasing spring holders 40 and 42. the user can vary the thickness of the mastic coat applied.

Finally. tool 100 includes a leaf spring and frame stop system that applies a constant outward force against frames 2 and 44 but which keeps the frames 2 and 44 from opening and sliding off of head casting 14. Referring to FIGS. 2 and 5 in particular. frame tension leaf-spring 8 is an elongated v-shaped leaf-spring inserted on the inside of tool 30 so that the middle of frame tension leaf-spring 8 is positioned between two spacer bushings 62 and 64 and so that each end of frame tension leaf-spring 8 is pressed against left and right frames 2 and 44. thereby producing outward forces on each frame that tends to push the frames away from each other and toward each wall in a corner when tool 100 is in use. Spring/frame stops 58 and 60 are attached to each side of the head casting 16 and 18 and the other ends of spring/frame stops 58 and 60 are attached to the frame-assembly uprights 70 and 72, left and right. thereby preventing the frames 2 and 44 from springing apart anymore than the spring/frame stops 58 and 60 permit.

Referring to FIG. 2, in using tool 1OO described herein, mastic applicator is inserted into the round cavity 20 formed in the center of the head casting 14, into which insert ket 54 has been placed. The mastic applicator is held in place in the cavity by ball clip spring 56 or other suitable means. Pressure is then applied against the mastic applicator and thereby to corner finishing tool 100, and the mastic flows from the mastic applicator through the cavity 20 in corner finishing tool 100 and is deposited on the wall.

Although a preferred embodiment of the invention has been illustrated and described, various modifications and changes may be resorted to without departing from the spirit of the invention or the scope of the appended claims, and each of such modifications and changes is contemplated.

We claim:

1. An improved corner finishing tool for applying mastic material along a wall joint, comprising container means that is open in two convergent and substantially perpendicular planes and having walls in each of said planes that converge peripherally of said cavity, said controller means comprising;

a pair of retainer walls rigidly joined at one edge;

a pair of convergent frmae members secured to said pair of retainer walls, respectively, each frame member being movable relative to the other frame member;

a pair of blades mounted along intersecting edges of said convergent frame members; and a wear pad mounted on said one edge of the retainer walls.

2. A corner finishing tool as described in claim 1, further comprising a pair of pivotally connected bottom frame members each secured perpendicularly of said frame members.

3. A corner finishing tool as described in claim 1, further comprising a pair of adjustable pads inserted between each side of said retainer walls and each of said frame members.

4. A corner finishing tool as described in claim 1, further comprising a pair of biasing means connected on one end to the inside of each said retainer walls and having a first position in which the other end of said biasing means is attached to said frame members (retainer plates) and a secon position in which no bias is applied.

5. A corner finishing tool as described in claim 1, further comprising a pair of spring members connected on one end to the inside of each of said retainer walls and attached on the other end to each of said frame members.

6. A corner finishing tool as described in claim 1, further comprising a wheel mounted on each of the retainer plates for rolling in a plane substantially parallel to the plane of either of said retainer walls.

7. An improved corner finishing tool for applying mastic material along a wall joint, comprising container means that is open in two convergent and substantially perpendicular planes and having walls in each of said planes that converge peripherally of said cavity, said container means comprising:

a pair of retainer walls joined at one edge;

a pair of convergent frame members secured to said pair of retainer walls, respectively, each frame member being movable relative to the other frame member;

a pair of blades mounted along intersecting edges of said convergent frame members ;

a wear pad mounted on said one edge of the retainer walls; and a pair of adjustable pads inserted between each side of said retainer walls and each of said frame members.

* * * * *

UNITED STATES PATENT AND TRADEMARK OFFICE

CERTIFICATE OF CORRECTION

PATENT NO. : 4,767,297

DATED : August 30, 1988

INVENTOR(S) : Morris F. Mower et al

It is certified that error appears in the above-identified patent and that said Letters Patent is hereby corrected as shown below:

Column 1, line 9, "." after known should be --,--

Column 1, line 14, "2,8241,447" should be --2,824,447--

Column 1, line 18, "." after joint should be --,--

Column 1, line 19, "." after however should be --,--

Column 1, line 20, "." after tool should be --,--

Column 1, line 33, "." after eliminated should be --,--

Column 1, line 53, "." after head should be --,--

Column 1, line 54, "." after smooth should be --,--

Column 1, line 56, "." after finally should be --,--

Column 2, line 3, "." after assembly should be --,--

Column 2, line 9, "." after particular should be --,--

Column 2, line 15, "1.2.4." should be --1,2,4,--

Column 2, line 16, "I00" should be --100--

Column 2, line 17, "." after 6 should be --,--

Column 2, line 20, "." after 44 should be --,--

Column 2, line 23, "." after 24 should be --,--

Column 2, line 33, "." after 68 should be --,--

UNITED STATES PATENT AND TRADEMARK OFFICE

CERTIFICATE OF CORRECTION

PATENT NO. : 4,767,297

DATED : August 30, 1988

INVENTOR(S) : Morris F. Mower et al

It is certified that error appears in the above-identified patent and that said Letters Patent is hereby corrected as shown below:

Column 2, line 40, "." after frame should be --,--

Column 2, line 54, "." after slots should be --,--

Column 2, line 55, "." after herein should be --,--

Column 2, line 57, after 30 should be --,--

Column 2, line 58, after 50 insert --,--

Column 2, line 59, "." after Similarly should be --,--

Column 2, line 61, "." after thus should be --,--

Column 2, line 67, after 100 insert --,--

Column 3, lines 7 and 8, delete "elongated member of spring steel or some other suitable"

Column 3, line 16, "." after 42 should be --,--

Column 3, line 18, "." after Finally should be --,--

Column 3, line 22, "." after particular should be --,--

Column 3, line 27, "." after 44 should be --,--

Column 3, line 34, "." after right should be --,--

Column 3, line 40, "insert ket" should be --insert socket--

Column 4, line 4, "controller" should be --container--

UNITED STATES PATENT AND TRADEMARK OFFICE

CERTIFICATE OF CORRECTION

PATENT NO. : 4,767,297

DATED : August 30, 1988

INVENTOR(S) : Morris F. Mower et al

It is certified that error appears in the above—identified patent and that said Letters Patent is hereby corrected as shown below:

Column 4, line 6, "frmae" should be --frame--

Column 4, line 23, after "each", insert --of--

Column 4, line 27, "secon" should be --second--

Signed and Sealed this

Seventh Day of March, 1989

*Attest:*

DONALD J. QUIGG

*Attesting Officer*

*Commissioner of Patents and Trademarks*